United States Patent [19]

Westerlund

[11] 3,994,798

[45] Nov. 30, 1976

[54] MODULE ELECTRODE ASSEMBLY FOR ELECTROLYTIC CELLS

[75] Inventor: H. Benny Westerlund, Vancouver, Canada

[73] Assignee: Gow Enterprises Ltd., Vancouver, Canada

[22] Filed: Sept. 30, 1975

[21] Appl. No.: 618,078

[30] Foreign Application Priority Data

Nov. 13, 1974 Canada ..... 213586

[52] U.S. Cl. ..... 204/268; 204/289

[51] Int. Cl.[2] ..... C25D 17/12

[58] Field of Search ..... 204/268, 254–256, 204/289

[56] References Cited

UNITED STATES PATENTS

| | | | |
|---|---|---|---|
| 3,779,889 | 12/1973 | Loftfield | 204/268 |
| 3,824,173 | 7/1974 | Bouy et al. | 204/268 X |
| 3,878,082 | 4/1975 | Gokhale | 204/256 X |

*Primary Examiner*—John H. Mack
*Assistant Examiner*—C. F. Lefevour
*Attorney, Agent, or Firm*—Millen, Raptes & White

[57] ABSTRACT

Novel bipolar electrodes are provided. Such electrodes include an anode in the form of a plate, which is made of a suitable anodic metal, e.g. platinum plated titanium. The cathode is also in the form of a metallic plate and also is formed of a suitable cathodic material, e.g. steel. The anode and cathode are joined to, but separated by, a generally U-shaped (in cross-section) median electrode plate formed, e.g., of titanium. A plurality of electrically insulating spacer elements, formed of a suitable plastics material, e.g. polyvinyl dichloride, project outwardly from both flat faces of at least the cathode plate by also if desired, from the anode plate. A bipolar electrolytic cell fitted with these novel bipolar electrodes has improved current efficiencies, leading to improved electrolyte flow, minimal gas entrapment, less overheating and improved operating load factors.

6 Claims, 4 Drawing Figures

MODULE ELECTRODE ASSEMBLY FOR ELECTROLYTIC CELLS

BACKGROUND OF THE INVENTION i. Field of the Invention

This invention relates to bipolar electrodes. More particularly, it relates to modular bipolar electrode assemblies specially adapted for use in a bipolar electrolytic cell, and to the bipolar electrolytic cell so provided.

ii. Description of the Prior Art

It is known that electrolytic cells for the production of metal chlorates using carbon electrodes have certain disadvantages. Monopolar cells inherently have many power connection and electrolytic branches and thus suffer from high electrode stub losses, high voltage drops and high power loss. Furthermore, many units are required in commercial production, and much larger building spaces are required.

Bipolar electrolytic cells designed to avoid many of the above difficulties have been mainly successful, but have brought about one major problem. Such cells have traditionally been designed to operate with a gas phase above the level of the liquid and below the cell cover. The electrical connections to the electrode (generally a graphite electrode) is situated in this gas phase and accordingly, the danger of sparks occuring with the resulting explosion is always present.

A major improvement is these types of bipolar electrolytic cells was provided in Canadian Pat. No. 714,778 issued Aug. 30, 1966 to G. O. Westerlund. In that patent, an electrolytic metal chlorate cell was provided which included a cell box provided with a closure. A plurality of bipolar electrodes were positioned in the cell box and were constructed and arranged to conduct electric current through the box and through a circulating electrolyte. Inlet means were provided to means associated with the closure to provide inlet to the cell box and a distribution means for the electrolyte inlet. Means were provided for inhibiting the accumulation of gaseous products of electrolysis in the zone adjacent the closure. Means were provided for circulating within the cell box by combined forced external pumping means and internal pumping action due to the construction and arrangement of the bipolar electrodes and the rising gaseous products of electrolysis. Means were also provided, external of the closure by associated therewith, for providing an outlet for the electrolyte and the gaseous products of electrolysis and for partially or completely separating the electrolyte from the gaseous products of electrolysis.

There have been further developments both in the design of electrolytic cells and in the design of the electrodes disposed therein. One such electrolytic cell is taught in U.S. Pat. No. 3,219,563 issued Nov. 23, 1965 to J. H. Collins et al. This patent provides a multi-electrolytic cell comprising a plurality of individual cell units made up of a cathode and an anode and an inter-electrode electrolysis space therebetween. The cells are arranged so that a partition (comprising an inert titanium sheet) carries the anode of one cell and the cathode of the next cell. Such inert titanium sheet not only separates the anode of one unit electrolytic cell from the cathode of an adjacent unit but is in electrical conducting relationship with respect both to the anode and the cathode carried thereby. The anode of one cell comprises a layer of a platinum metal on one side of the titanium metal portition, and the cathode of the adjacent cell comprises of a layer of a platinum metal or iron or steel on the other side of the titanium metal partition.

Electrolytic cells generally have included complex construction in order to facilitate the mounting of electrodes. Another new development in cell design is shown in Canadian Pat. No. 914,610 issued to G. O. Westerlund for multi-monopolar electrolytic cell assembly. Although this design has a proven efficient performance, the construction is not one which can readily be carried out in the field. This is because the modular cell assembly comprises a plurality of electrode plates which must be carefully fitted when assembling the multi-unit cell in order to avoid electrical short circuiting between adjacent cell modules. Cells designed for operation under low voltage conditions by having close spacing between electrodes are thus not readily maintained or constructed in the field. This disadvantage also applies to most other high efficiency electrolytic cells.

The above-identified Canadian Pat. No. 914,610 also provides novel metal electrode constructions for electrolytic cells. However, according to that patent, the combined electrolyzer reactor employed an electrode arrangement where all anodes were welded to a first carrier plate. A second carrier plate was provided having cathode steel plates. In the electrolyzer the cathodes of the second carrier plate were fitted between the anodes of the first carrier plate. This required, on the average, 8 hours for fitting within the cell, in order to avoid the presence of any electrical short circuits.

SUMMARY OF THE INVENTION i. Aims of the Invention

Accordingly, an object of this invention is to provide an electrode assembly which readily fits into an electrolysis cell, and is easily removed and exchanged from such cell.

Another object of this invention is to provide means for fitting electrode assemblies in an electrolysis cell, such means preferably having the purpose of equivalization of electrical potential at intermediate position of electrodes where electron polarity in the assembly changes for electrical current flow.

Still another object of this invention is to provide a means for dividing the assembly of anode and cathode respectively and thereby to provide a wall effect when fitted with other assemblies, thereby substantially to eliminate current leakage path from one cell to an adjacent cell at that position.

Still another object of this invention is to provide an electrode assembly which is adaptable to most conventional electrolyzers employing the bipolar electrode principle with electrical current flow from one cell to an adjacent cell in a multi-cell electrolyzer.

Another aspect of this invention is to provide an assembly which facilitates structural strength and rigidity allowing employing either thin or thick electrode plates, and of dimensions best serving the economics of the electrolyzer capital cost and product manufacturing cost.

Still another object of this invention is to provide an assembly which, when fitted in an electrolyzer, provides the desired spacing between electrodes uniformly over the electrode surface.

Yet another object of this invention is to provide an assembly which could employ the same or different base electrode materials for the anode and the cathode respectively without causing substantial corrosive action at the joint of the electrodes.

ii. Statement of Invention

According to this invention, a bipolar electrode is provided comprising (1) a plate-like metallic anode formed of anode material; (2) a plate-like metallic cathode formed of cathode material; (3) a generally U-shaped in cross-section median electrode plate formed of titanium or a titanium alloy, interposed between, and connected to, each of the plate-like metallic anode and the plate-like metallic cathode, the median electrode extending below the bottom edge of the plate-like metallic anode and the plate-like metallic cathode, and extending above the top edge of the plate-like metallic anode and the plate-like metallic cathode; and (4) a plurality of electrically insulating spacer elements projecting outwardly from both side faces of at least the plate-like metallic cathode.

iii. Other features of the Invention

This invention also provides a modular bipolar electrode assembly comprising a plurality of bipolar electrodes each comprising: (1) a plate-like metallic anode formed of anode material; (2) a plate-like metallic cathode formed of cathode material; (3) a generally U-shaped in cross-section median electrode plate formed of titanium or a titanium alloy, interposed between, and connected to, each of the plate-like metallic anode and the plate-like metallic cathode, the median electrode extending below the bottom edge of the plate-like metallic anode and the plate-like metallic cathode, and extending above the top edge of the plate-like metallic anode and the plate-like metallic cathode; and (4) a plurality of electrically insulating elements projecting outwardly from both side faces of at least the plate-like metallic cathode; and further including at least two median electrodes each interposed between, and connected to, a plate-like metallic anode and a plate-like metallic cathode, with the anodes and cathodes interleaved and spaced apart by the electrically non-conductive spacers, and with adjacent median electrode plates in electrical connection with each other and adapted to provide current flow transversely of the assembly.

Another variant of this invention resides in the fact that modules of electrode assemblies are provided, comprising a plurality of modular bipolar electrode assemblies, each comprising: (1) a plate-like metallic anode formed of anode material; (2) a plate-like metallic cathode formed of cathode material; (3) a generally U-shaped in cross-section median electrode plate formed of titanium or a titanium alloy, interposed between, and connected to, each of the plate-like metallic anode and the plate-like metallic cathode, the median electrode extending below the bottom edge of the plate-like metallic anode and the plate-like metallic cathode, and extending above the top edge of the plate-like metallic anode and the plate-like metallic cathode; and (4) a plurality of electrically insulating spacer elements projecting outwardly from both side faces of at least the plate-like metallic cathode; and further including at least two median electrodes each interposed between, and connected to, a plate-like metallic anode and a plate-like metallic cathode, with the anodes and cathodes interleaved and spaced apart by the electrically non-conductive spacers, and with adjacent U-shaped median electrode plates in electrical connection with each other and adapted to provide current flow transversely of the assembly, which are disposed in a framework including a plurality of transversely extending titanium support plates within which the upwardly extending slot is accomodated, thereby to cooperate with the electrically connected median electrodes and adapted to provide current flow transversely of the assemblies.

This invention provides, still further a bipolar electrolytic cell including an enclosed box electrolyte inlet means, electrolyte outlet means, and a plurality of modules of electrode assemblies, each comprising: (1) a plate-like metallic anode formed of anode material; (2) a plate-like metallic cathode formed of cathode materials; (3) a generally U-shaped in cross-section median electrode plate formed of titanium or a titanium alloy, interposed between, and connected to, each of the plate-like metallic anode and the plate-like metallic cathode, the median electrode extending below the bottom edge of the plate-like metallic anode and the plate-like metallic cathode, and extending above the top edge of the plate-like metallic anode and the plate-like metallic cathode; and (4) a plurality of electrically insulating spacer elements projecting outwardly from both side faces of at least the plate-like metallic cathode; and further including at least two median electrodes each interposed between, and connected to, a plate-like metallic anode and a plate-like metallic cathode, with the anodes and cathodes interleaved and spaced apart by the electrically non-conductive spacers, and with adjacent U-shaped median electrode plates in electrical connection with each other and adapted to provide current flow transversely of the assembly, which are disposed in a framework including a plurality of transversely extending titanium support plates within which the upwardly extending slot is accomodated, thereby to cooperate with the electrically connected median electrodes and adapted to provide current flow transversely of the assemblies, and zone above the anodes and the cathodes providing an upper, non-electrolysis zone for electrolyte and gaseous products of electrolysis, and the zone below the anodes and the cathodes providing a lower chamber for electrolyte inflow.

BRIEF DESCRIPTION OF THE DRAWINGS

In the accompanying drawings.

DETAILED DESCRIPTION OF THE DRAWINGS i. Description of FIG. 1

Figure 1:
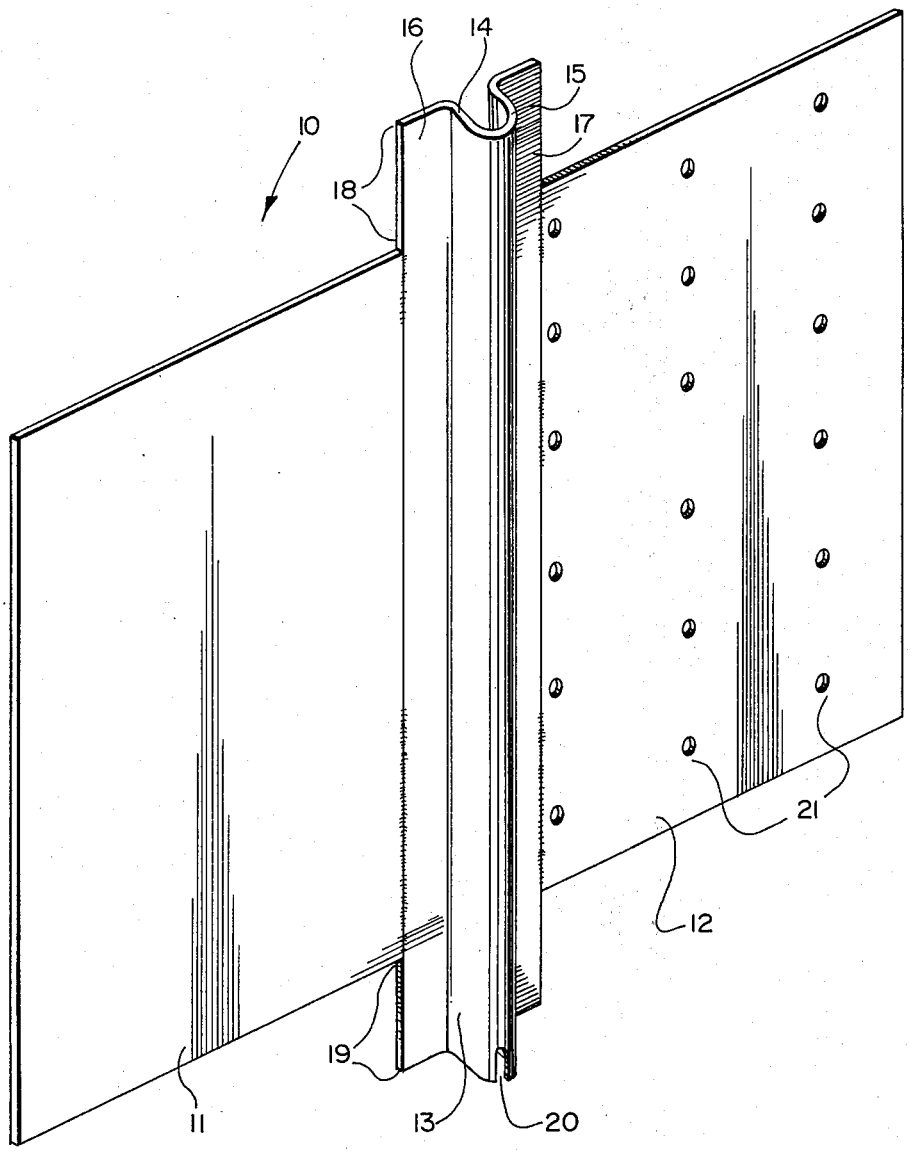
FIG. 1 is a perspective view of a bipolar electrode of one aspect of this invention.

As seen in FIG. 1, the bipolar electrode 10 includes a generally plate-like metallic anode 11, a generally platelike metallic cathode 12 separated by, and connected to, an upstanding median metallic electrode 13, having a generally U-shaped cross-section, and constituted by a pair of spaced-apart legs 14, 15, each having a lateral wing 16, 17, respectively, extending therefrom, by which the median electrode is connected to the anode 11 and cathode 12. The material for the anode 11 is a "suitable anodic material". This may be defined as a material that is electrical conductive, is resistant to oxidation, and is substantially inoluble in the electrolyte. Platinum is the preferred material, but it would also be possible to use ruthenium, rhodium, palladium, osmium, iridium, and alloys of two or more of the above metals, or oxides of such metals.

The material for the cathode 12 is a "suitable cathodic material." This may be defined as a material which is electrically conductive, or substantially insoluble in the electrolyte under cathodic conditions, is resistant to reduction, and either is substantially impermeable with respect to $H_2$, or if permeable by $H_2$, is dimensionally stable with respect to $H_2$. Steel is the preferred material, but it would also be possible to use copper, chromium, cobalt, nickel, lead, tin, iron or alloys of the above metals.

ii. Description of FIGS. 2 and 3

Figure 2:
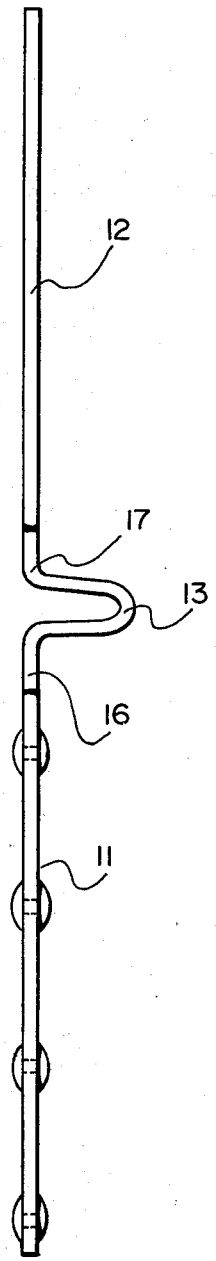
FIG. 2 is a top plan view of one aspect of a bipolar electrode of one aspect of this invention.
Figure 3:
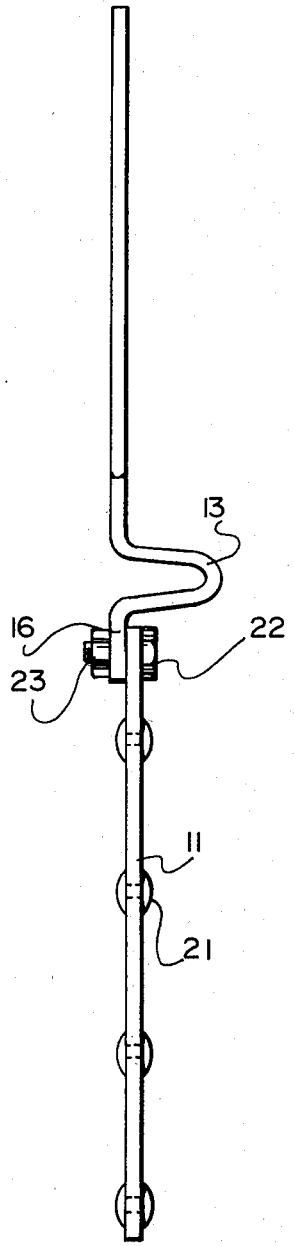
FIG. 3 is a top plan view of another aspect of one aspect of this invention.

As seen in FIG. 2, the median electrode 13 is connected to the anode 11 at a butt edge at lateral wing 16, and to the cathode 12 at a butt edge at lateral wing 17. The connection is by means of welding. As seen in FIG. 3, the median electrode 13 is connected to the anode 11 at a lapped joint between anode 11 and lateral wing 16 by means of a bolt or a screw 22, 23.

The median electrode 13 is provided with an upper extension 18 and lower extension 19. Lower extension 19 is provided with an upwardly extending slot 20.

As shown the cathode 12 is provided with a plurality of spaced-apart electrically non-conductive spacer rods 21 which project outwardly from both flat faces of cathode 12. The anode 11 may also, if desired be provided with such spaced rods 21.

The median electrode 13 is preferably made of titanium or a titanium alloy. In addition, other metals for the median electrode include tantalum, zirconium and columbium and alloys of such metals. This facilitates the conducting of electric power longitudinally from the cathode plate 12 to the anode plate 11.

In addition, the median electrode 13 conducts electric power transversely through the cell when fitted in an electrolyzer in the form of a module to be further described with reference to FIG. 3, to lower the potential differences between fitted assemblies. Ths tends to improve overall voltage from the electrolyzer. Contact resistance between two adjacent median electrodes 13 when fitted in the electrolyzer, in the form of a module to be further described with reference to Fig. 3, depends upon the shape of the median electrode 13 by a range of 0.1 to 0.5 ohms/mm$^2$ is attainable.

In order to operate in an essentially non-corrsive manner when performing in an electrolyte, one side of the median electrode 13 should be anodically charged and the other side should be cathodically charged. In performing as a cathode, the titanium will form a hydride and consequently some corrosion may occur should the electrolyte temperature be excessive (i.e., above about 100° C.) and equalization of electrical potential in the cell under such circumstances would be poor. No visual corrosion is experienced, however, under normal conditions and under most adverse conditions. In performing as an anode, the titanium would oxidize. No visual corrosion has been experienced except if the electrical cell potential in commerical grade chloride solutions exceeds about 9 volt.

It is seen, referring again to Fig. 2, that the joint may be welded. The anodes employed are of titanium, which is surface coated with platinum to improve anode performance. The cathodes employed are of titanium, which is surface coated or treated to improve their cathode performance as cathode surface by the use of a coating of a "suitable"cathodic material"(as heretofore defined). For example, titanium sheet of about 1.5 mm thick having a low carbon steel cathode surface was welded and successfully used as the cathode. The coated electrodes may be made using the explosion bonding technique described in Canadian Pat. No. 760,427 issued June 6, 1967 to Ono et al.

Impurities in the weld of titanium tend to weaken the weld and to cause corrosion at the joint. It is therefore recommended that the butt-end to be welded be taped during the welding procedure to avoid impurities in the weld. Titanium was also successfully used as cathode material using a grit of aliuminum oxide to increase its surface area.

Referring now again to FIG. 3, a screwed or bolted joint where the cathode material is other than titanium is successful by using bolts or rivets of as small a diameter as about 4 mm with at least one bolt for ever 10 amperage. The voltage drop for this joint is normally less than about 3 millivolt.

The cathode plate 12 is punched and equipped with spacer rods 21. These spacer rods are designed to provide the cell spacing when the electrode is fitted in the cell. A suitable spacer is made of polyvinyl dichloride (PVDC). Other suitable electrically non-conductive plastics materials are those known by the Trade Marks of Kynar, Kel-F or Teflon. The spacer rods 21 may be produced by employing extruded rods which are slightly less in diameter than the holes punched in the cathode 12 with a length cut to yield the desired protrusion on the sheets. If the rods are made of PVDC, the cathode plate 12 is baked at about 300° C. for about 2 minutes; the PVDC rods swell to form the spacer 21 at the same time as it longitudinally shrinks. If Kymar, Kel-F or Teflon are used, applied pressure is required. Normally the spacer rods 21 protrude from about 1 to 5 mm. The number of spacers depends on the thickness of cathode 12, its flatness and the desired spacing. For example, 2 mm thick standard steel cathodes 12 having in thickness of about 2 mm having a spacing of about 3 mm required approximately 100 mm between spacer rods 21. Although it is preferred to apply the spacer rods 21 to the cathodes 12, they may equally well be applied to the anode 11.

iii. Description of FIG. 4

Figure 4:
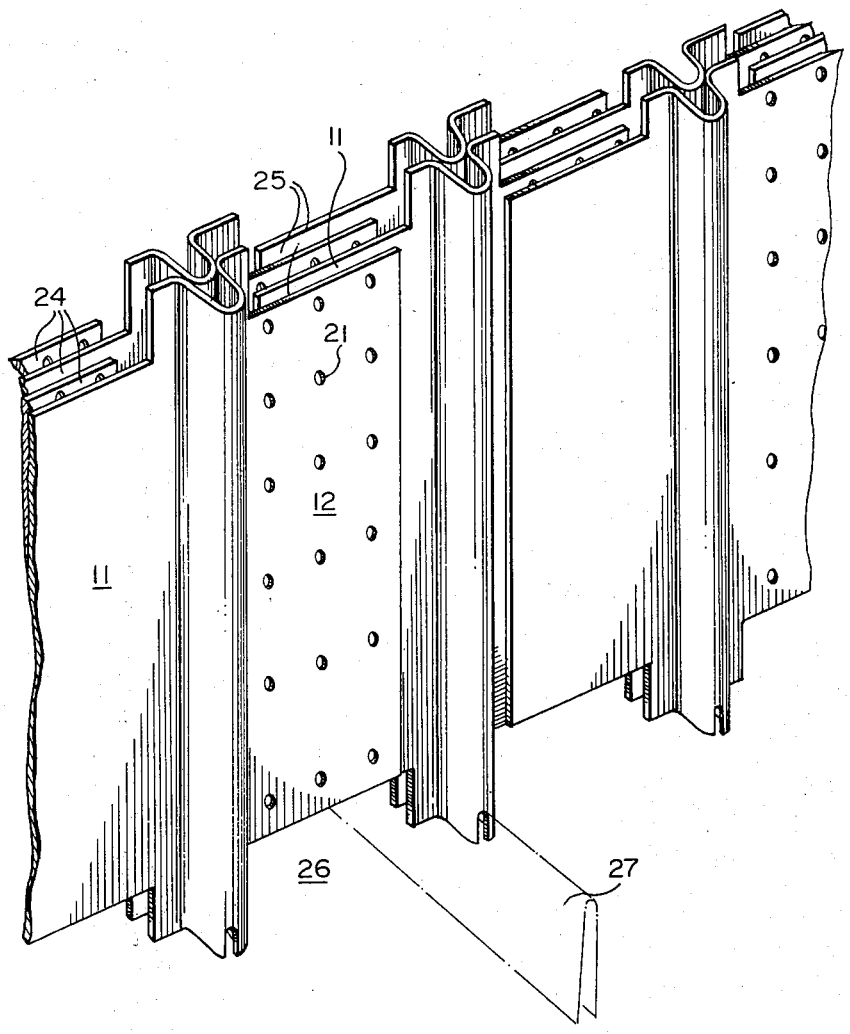
FIG. 4 is a perspective view of an electrode assembly module of another aspect of this invention.

As seen in FIG. 4, the electrode assembly includes the interleaving of the anodes 11 with the cathodes 12, the interelectrode spacing 24 being defined by the spacer rods 21, and also by the curvature of the median electrode 13 which are in front face-to-rear face contact.

One such electrode assembly is between imaginary center line "$n$" and adjacent imaginary center line "$n+1$ comprising a multiple of anodes 11, cathodes 12 and median electrodes 13. Median electrodes 13 are fitted by hand compression into its U-shape, with slot 20 along imaginary center line $n$, $n+1$, $n+2$, etc. The slot 20 in the median electrode is adapted to rest on transverse titanium conductor plate 27. The upper extension 18 provides an upper zone 25 for electrolyte and gaseous products of electrolysis, and the lower extension 19 provides a lower zine 26 for electrolyte inflow. This is shown in greater detail in FIG. 4 showing the novel bipolar electrolytic cell of this invention.

It is thus shown that a plurality of electrode assembly modules are very readily made up with essentially no limitations as to capacity since the number of electrode assembly modules fitted longitudinally ($n$, $n+1$, $n+2$, etc.) determines total production output for an electrolyzer.

It is desired to point out that the upper and lower extensions 18 and 19 respectively also lengthen the path from the anode side 11 to the cathode 12 which, in most cases, substantially eliminates corrosion action at the top and the bottom respectively on cathode 12 by electrical potential difference between two adjacent cells when employed in the electrolyzer. For current densities above about 1000 A/M$^2$ electrolyzing chloride and chlorate solution employing mild steel cathodes at temperatures up to about 95° C., the extensions should preferably be more than about 30 mm. Electrical energy is transmitted across the cell by current conduction defined by touching median electrodes 13 and titanium conductor plates 27.

A typical cell voltage, employing anodes of about 1000 mm high spaced about 3 to about 5 mm from cathodes electrolyzing brine and chlorate solution at about 70° to about 90° C., where the anodes were platinum surface coated titanium and where the cathodes were mild steel, was about 3.3 to about 3.7 volt at a current density of about 1500 ampere per square meter, compared to a variance of about 3.0 to about 3.3, using the electrode assembly of this invention which was installed and operating under the same operating conditions. The oxygen content in the cell gas, which indicates current inefficiency was about 4 to about 6% by volume, using electrodes of the prior art, but improved to the range of about 2 to about 4% using the electrodes of this invention, representing approximately 4% improved current efficiency.

EXAMPLE

An electrolyzer fitted with electrode assembly modules comprising anodes and cathodes of 300 × 1000 mm surface area for each face of plate, with spacers 3 mm protrusion, 12 assembly modules wide and 56 cells in the electrolyzer, produced sodium chlorate at approximately 5600 KWH per ton with strength up to 900 grams per liter.

SUMMARY

In summary, therefore, the improved assembly of this invention shortens fitting time. Subsequent operating provided overall better voltages and current efficiency by uniform spacing between electrode plates, thus improving electrolyte flow, minimizing gas entrapment, overheating, improved electrolyzer operating load factor and maintainance.

From the foregoing description, one skilled in the art can easily ascertain the essential characteristics of this invention, and without departing from the spirit and scope thereof, can make various changes and modifications of the invention to adapt it to various usages and conditions. Consequently, such changes and modifications are properly, equitably, and "intended" to be, within the full range of equivalence of the following claims.

I claim:

1. A bipolar electrode comprising:

1. a generally rectangular plate-like metallic anode formed of anode material;
2. a generally rectangular plate-like metallic cathode formed of cathode material, said plate-like metallic cathode being substantially co-planar with said anode and having an edge substantially parallel to and spaced from an edge of said anode;
3. a generally U-shaped in cross-section median electrode plate formed of titanium or a titanium alloy, interposed between, and connected to, said edges of the plate-like metallic anode and the plate-like metallic cathode, the median electrode extending below the bottom edge of the plate-like metallic anode and the plate-like metallic cathode, and extending above the top edge of the plate-like metallic anode and the plate-like metallic cathode;
4. a plurality of electrically insulating spacer elements projecting outwardly from both side faces of at least the plate-like metallic cathode.

2. The bipolar electrode of claim 1 including at least two median electrodes each interposed between, and connected to, a plate-like metallic anode and a plate-like metallic cathode.

3. The bipolar electrode of claim 1 in which the lower extension of the median electrode is provided with an upwardly extending slot.

4. A modular bipolar electrode assembly comprising a plurality of bipolar electrodes, each comprising:

1. a generally rectangular plate-like metallic anode formed of anode material;
2. a generally rectangular plate-like metallic cathode formed of cathode material, said plate-like metallic cathode being substantially co-planar with said anode and having an edge substantially parallel to and spaced from an edge of said anode;
3. a generally U-shaped in cross-section median electrode plate formed of titanium or a titanium alloy, interposed between, and connected to, said edges of the platelike metallic anode and the plate-like metallic cathode, the median electrode extending below the bottom edge of the plate-like metallic anode and the plate-like metallic cathode, and extending above the top edge of the platelike metallic anode and the plate-like metallic cathode; and
4. a plurality of electrically insulating spacer elements projecting outwardly from both side faces of at least the plate-like matallic cathode;

and further including at least two median electrodes each interposed between, and connected to, a plate-like metallic anode and a plate-like metallic cathode, with the anodes and cathodes interleaved and spaced apart by the electrically non-conductive spacers, and with adjacent U-shaped median electrode plates in electrical connection with each other and adapted to provide current flow transversely of the assembly.

5. Modules of electrode assemblies comprising a plurality of modular bipolar electrode assemblies, each comprising:

1. a generally rectangular plate-like metallic anode formed of anode material;
2. a generally rectangular plate-like metallic cathode formed of cathode material, said plate-like metallic cathode being substantially co-planar with said anode and having an edge substantially parallel to and spaced from an edge of said anode;

3. a generally U-shaped in cross-section median electrode plate formed of titanium or a titanium alloy, interposed between, and connected to, said edges of the platelike metallic anode and the plate-like metallic cathode, the median electrode extending below the bottom edge of the plate-like metallic anode and the plate-like metallic cathode, and extending above the top edge of the platelike metallic anode and the plate-like metallic cathode; and 4. a plurality of electrically insulating spacer elements projecting outwardly from both side faces of at least the plate-like metallic cathode;

and further including at least two median electrodes each interposed between, and connected to, a plate-like metallic anode and a plate-like metallic cathode, with the anodes and cathodes inteleaved and spaced apart by the electrically nonconductive spacers, and with adjacent U-shaped median electrode plates in electrical connection with each other and adapted to provide current flow transversely of the assembly, which are disposed in a framework including a plurality of transversely extending titanium support plates within which the upwardly extending slot is accomodated, thereby to cooperate with the electrically connected median electrodes and adapted to provide current flow transversely of the assemblies.

6. A bipolar electrolytic cell including an enclosed box electrolyte inlet means, electrolyte outlet means, and a plurality of modules of electrode assemblies, each comprising:

1. a generally rectangular plate-like metallic anode formed of anode material;

2. a generally rectangular plate-like metallic cathode formed of cathode material, said plate-like metallic cathode being substantially co-planar with said anode and having an edge substantially parallel to and spaced from an edge of said anode;

3. a generally U-shaped in cross-section median electrode plate formed of titanium or a titanium alloy, interposed between, and connected to, said edges of the plate-like metallic anode and the plate-like metallic cathode, the median electrode extending below the bottom edge of the plate-like metallic anode and the plate-like metallic cathode, and extending above the top edge of the plate-like metallic anode and the plate-like metallic cathode; and 4. a plurality of electrically insulating spacer elements projecting outwardly from both side faces of at least the plate-like metallic cathode;

and further including at least two median electrodes each interposed between, and connected to, a plate-like metallic anode and a plate-like metallic cathode, with the anodes and cathodes interleaved and spaced apart by the electrically non-conductive spacers, and with adjacent U-shaped median electrode plates in electrical connection with each other and adapted to provide current flow transversely of the assembly, which are disposed in a framework including a plurality of transversely extending titanium support plates within which the upwardly extending slot is accomodated, thereby to cooperate with the electrically connected median electrodes and adapted to provide current flow transversely of the assemblies, the zone above the anodes and the cathodes providing an upper, nonelectrolysis zone for electrolyte and gaseous products of electrolysis, and the zone below the anodes and the cathodes providing a lower chamber for electrolyte inflow.

* * * * *

UNITED STATES PATENT AND TRADEMARK OFFICE

CERTIFICATE OF CORRECTION

PATENT NO. : 3,994,798

DATED : November 30, 1976

INVENTOR(S) : WESTERLUND

It is certified that error appears in the above-identified patent and that said Letters Patent are hereby corrected as shown below:

Claim 5, column 9, line 17:

Change "inteleaved" to -- interleaved --.

Signed and Sealed this

Twenty-second Day of March 1977

[SEAL]

*Attest:*

RUTH C. MASON
*Attesting Officer*

C. MARSHALL DANN
*Commissioner of Patents and Trademarks*